US006997459B2

(12) United States Patent
von Goeben

(10) Patent No.: US 6,997,459 B2
(45) Date of Patent: Feb. 14, 2006

(54) ELECTRONIC TOUCH GAME

(75) Inventor: Robert von Goeben, 565 Belvedere St., San Francisco, CA (US) 94117

(73) Assignee: Robert von Goeben, San Francisco, CA (US)

( * ) Notice: Subject to any disclaimer, the term of this patent is extended or adjusted under 35 U.S.C. 154(b) by 0 days.

(21) Appl. No.: 10/928,685

(22) Filed: Aug. 26, 2004

(65) Prior Publication Data

US 2005/0023764 A1 Feb. 3, 2005

Related U.S. Application Data

(62) Division of application No. 10/631,913, filed on Jul. 30, 2003.

(51) Int. Cl.
*A63B 63/00* (2006.01)

(52) U.S. Cl. ..... 273/348

(58) Field of Classification Search ..... 463/8, 463/47; 273/348, 445, 454
See application file for complete search history.

(56) References Cited

U.S. PATENT DOCUMENTS

| | | | | |
|---|---|---|---|---|
| 3,063,718 | A | 11/1962 | Steinkamp | |
| 4,761,006 | A | 8/1988 | Ledbetter | |
| 4,974,833 | A * | 12/1990 | Hartman et al. | 482/3 |
| 4,986,548 | A | 1/1991 | Conner | |
| 5,100,152 | A | 3/1992 | Butler, III | |
| 5,938,549 | A | 8/1999 | Schenkenfelder | |
| 6,004,232 | A | 12/1999 | Sennott | |
| 6,110,079 | A * | 8/2000 | Luedke et al. | 482/83 |
| 6,530,841 | B1 | 3/2003 | Bull et al. | |
| 2004/0063480 | A1 | 4/2004 | Wang | |
| 2004/0171412 | A1 * | 9/2004 | Vollmar, Jr. | 463/8 |
| 2005/0071025 | A1 * | 3/2005 | Cogorno et al. | 700/92 |

OTHER PUBLICATIONS

International Search Report and The Written Opinion of the International Searching Authority, or the Declaration for International Application No. PCT/US04/24652, International Filing Date Jul. 29, 2004, date of mailing: Dec. 20, 2004, pp. 10 total.

* cited by examiner

*Primary Examiner*—Kim Nguyen
(74) *Attorney, Agent, or Firm*—Blakely, Sokoloff, Taylor & Zafman LLP

(57) ABSTRACT

A hand-to-hand game that uses a touch pad sensor and a controller to count the number of times the touch pad sensor is touched. The controller and touch pad are a wearable electronic scoring device that is attached to the body of a person through an attaching device.

2 Claims, 9 Drawing Sheets

700

ELECTRONIC TOUCH GAME

RELATED APPLICATIONS

This application is a divisional of U.S. patent application Ser. No. 10/631,913, filed Jul. 30, 2003.

FIELD OF THE INVENTION

The present invention relates to a novel hand-to-hand physical game that incorporates a wearable electronic scoring device together with low-impact rules of engagement.

BACKGROUND OF THE INVENTION

Hand-to-hand games and competitions have existed for centuries. People of all ages are continually intrigued by games of physical contact with an opponent. Physical hand-to-hand games have always been popular as both professional spectator sports and amateur participation sports. Two examples of hand-to-hand games are boxing and wrestling. In these sports, very little innovation has occurred in the technology of scoring or in the rules of engagement.

One problem with hand-to-hand games is they are universally scored by subjective human judging and do not incorporate any objective electronic scoring technology. For example, in wrestling, a match that ends without one contestant pinning his opponent in the allotted time will be subjectively judged by a referee that determines points for take-downs, reversals, and other maneuvers throughout the match. Similarly in boxing, a match that ends without a TKO or knockout will be subjectively judged by the number and accuracy of the blows to each opponent, and the ultimate winner is determined by this judging.

Subjective judging has always created problems in the accuracy of scoring these games. For example, subjective scoring results in missed points, improperly awarded points, and can also result in excessive physical contact. Subjective scoring also results in frequent disagreements between officials and players because of the different perspectives of each person. Games that require scoring to be done solely amongst players, without the use of a third party judge or official, will often result in disagreements between opponents.

Some games, such as fencing and laser tag, have tried to remove the subjective scoring by incorporating electronic scoring; however, these games are contests in the mastery of a weapon and are not hand-to-hand games. Therefore, it would be desirable to have a hand-to-hand game that incorporates objective scoring technology.

Another problem with prior hand-to-hand games is they require high-impact physical confrontations in order for an opponent to win the game. For example, in wrestling and boxing, the winner typically is the contestant that can take down or knock out their opponent. These types of high-impact games require lengthy physical and mental training, and often involve a high risk of physical injury. It would be desirable to have a game that includes a hand-to-hand game system that is objectively scored using electronics, and that incorporates the compelling nature of physical contest using low-impact rules of engagement.

BRIEF DESCRIPTION OF THE DRAWINGS

The present invention is illustrated by way of example, and not by way of limitation, in the figures of the accompanying drawings and in which like reference numerals refer to similar elements and in which.

DETAILED DESCRIPTION

In the following description, numerous specific details are set forth such as examples of components, rules of the game, and variations of the rules, etc. in order to provide a thorough understanding of the present invention. It will be apparent, however, to one skilled in the art that these specific details need not be employed to practice the present invention. In other instances, well known components or methods have not been described in detail in order to avoid unnecessarily obscuring the present invention.

Figure 1:
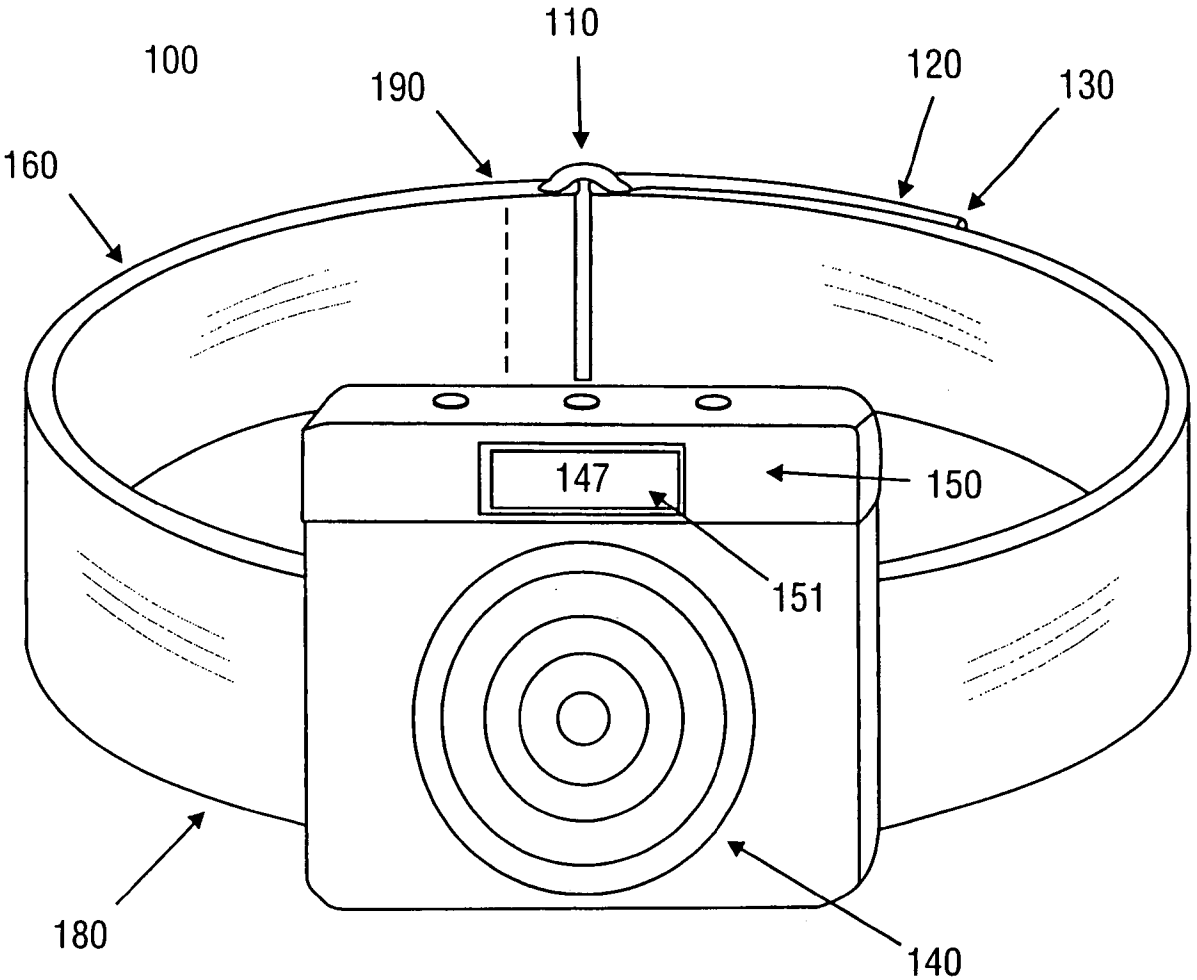
FIG. 1 illustrates the front view of an electronic touch system for playing a hand-to-hand game.

FIG. 1 illustrates a front view of one embodiment of an electronic touch system 100. The electronic touch system 100 includes an attaching device 180, an electronic touch controller 150, and a touch pad 140. The attaching device 180 includes, for example, an attachment loop 110 and a flexible strap member 160 having a first attaching device 120 and a second attaching device 130. The attachment loop 110 attaches to the strap member 160 using an attaching device 190. The first attaching device 120 of strap member 160 is fed through the attachment loop 110 and attaches to the second attaching device 130. The strap member 160 is made of flexible material, and the attaching devices 120 and 130 may be adjusted to accommodate various sizes. Conventional attaching devices are well known to those of ordinary skill in the art. For example, in another embodiment, the attaching device 180 may include only a strap member 160 and attaching devices 120 and 130. The electronic touch system 100 also includes a touch pad sensor 140, and an electronic touch controller 150. The electronic touch controller 150 includes a display 151. Conventional displays and touch pad sensors are well known to those of ordinary skill in the art. It should be noted, however, that the description of the electronic touch controller 150 using one display 151 is only for illustrative purposes and is not meant to be limited to one display on an electronic touch controller.

Figure 2:
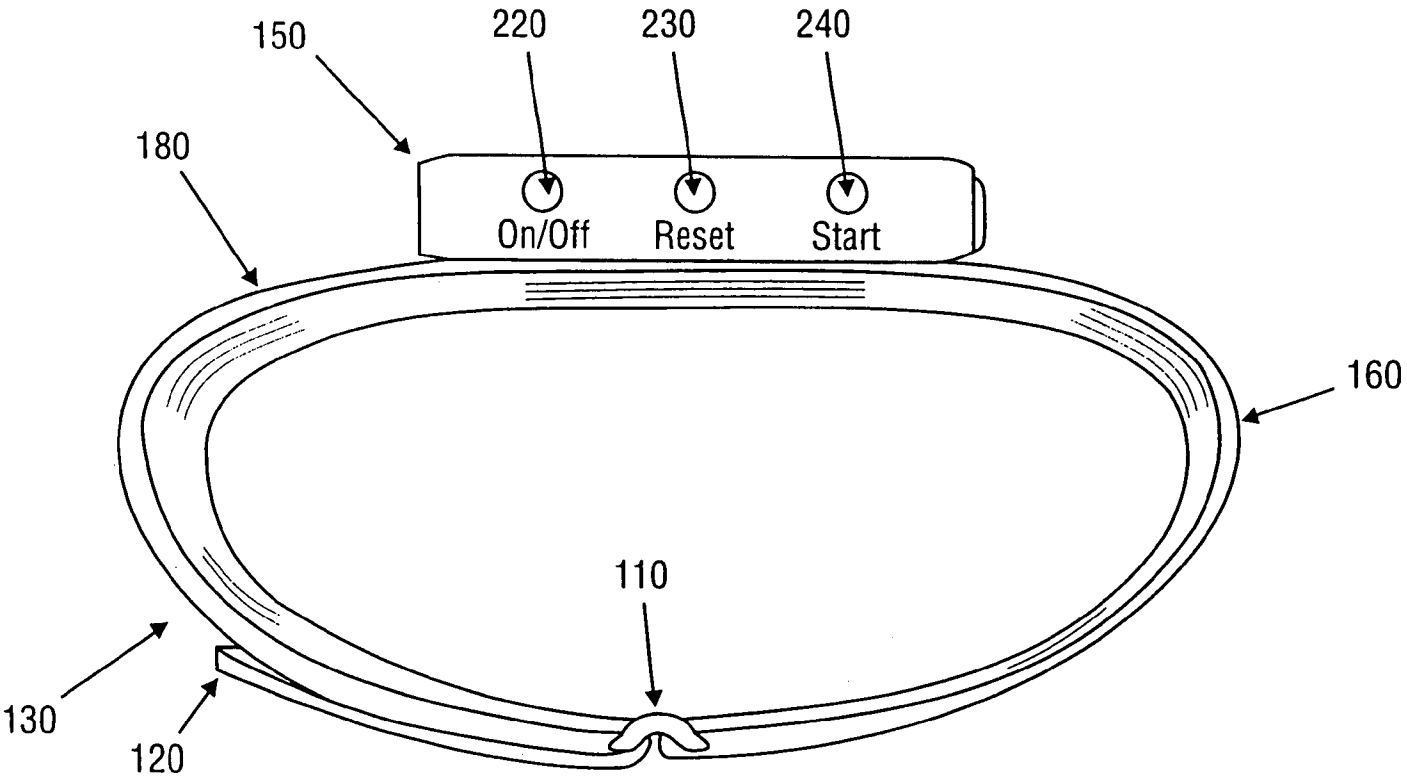
FIG. 2 illustrates a top view of one embodiment of an electronic touch system.

FIG. 2 illustrates a top view of the embodiment of FIG. 1. FIG. 2 further illustrates that the electronic touch controller 150 includes an ON/OFF button 220, a Reset button 230, and a Start button 240. These buttons and displays are mounted to the electronic touch controller 150, and are used as the user interface to the electronic touch controller 150. Conventional buttons are well known to those of ordinary skill in the art.

Figure 3:
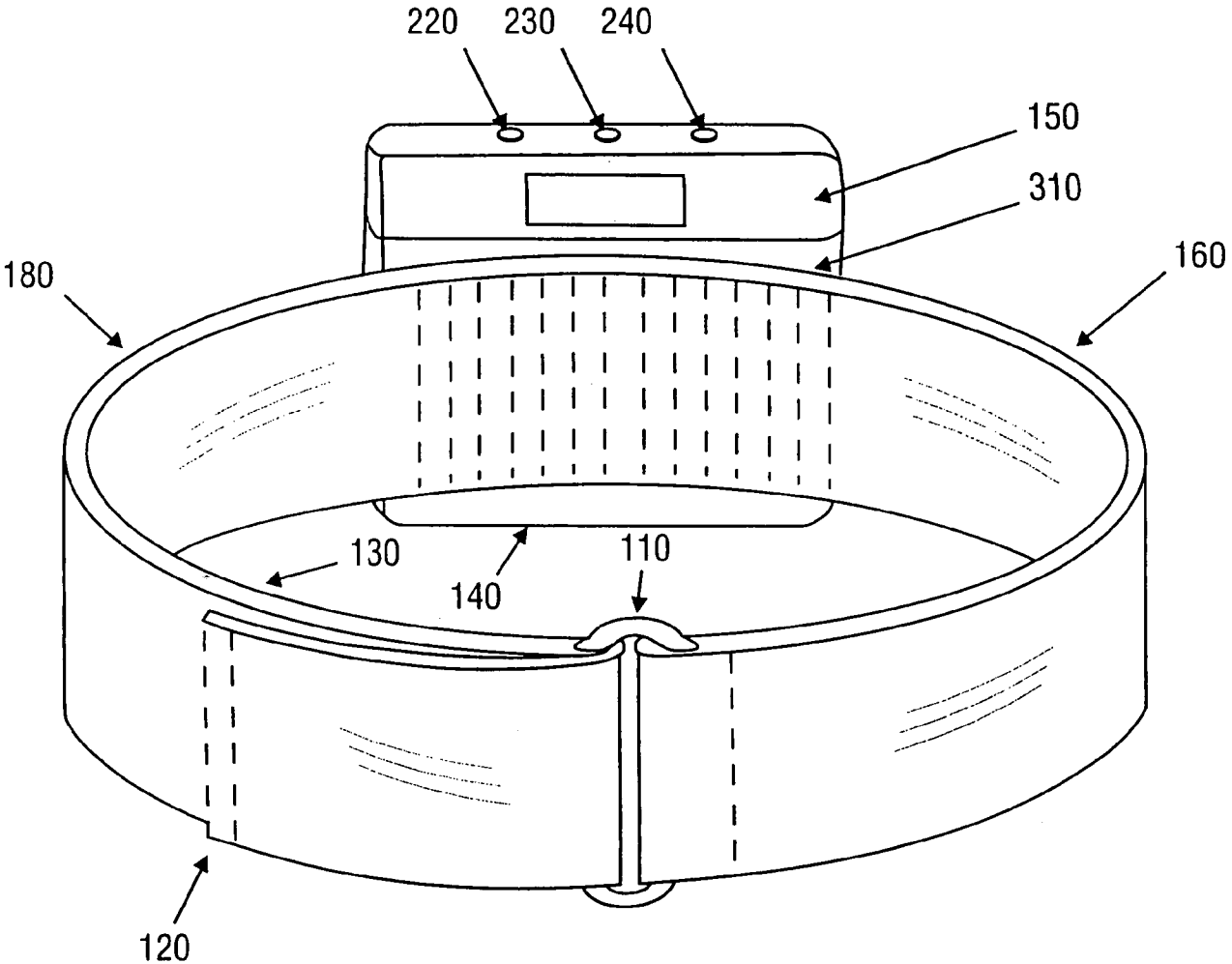
FIG. 3 illustrates a back view of one embodiment of an electronic touch system.

FIG. 3 illustrates the back view of the embodiment of FIG. 1. FIG. 3 further illustrates that the electronic touch controller 150 and the touch pad 140 are attached to the strap member 160 of the attaching device 180 through another attaching device 310. Conventional attaching devices are well known to those of ordinary skill in the art. For example, in one embodiment, the attaching device 310 could include a clipping device for attaching the controller 150 directly to the clothing of an individual without the use of the attaching device 180.

Figure 4:
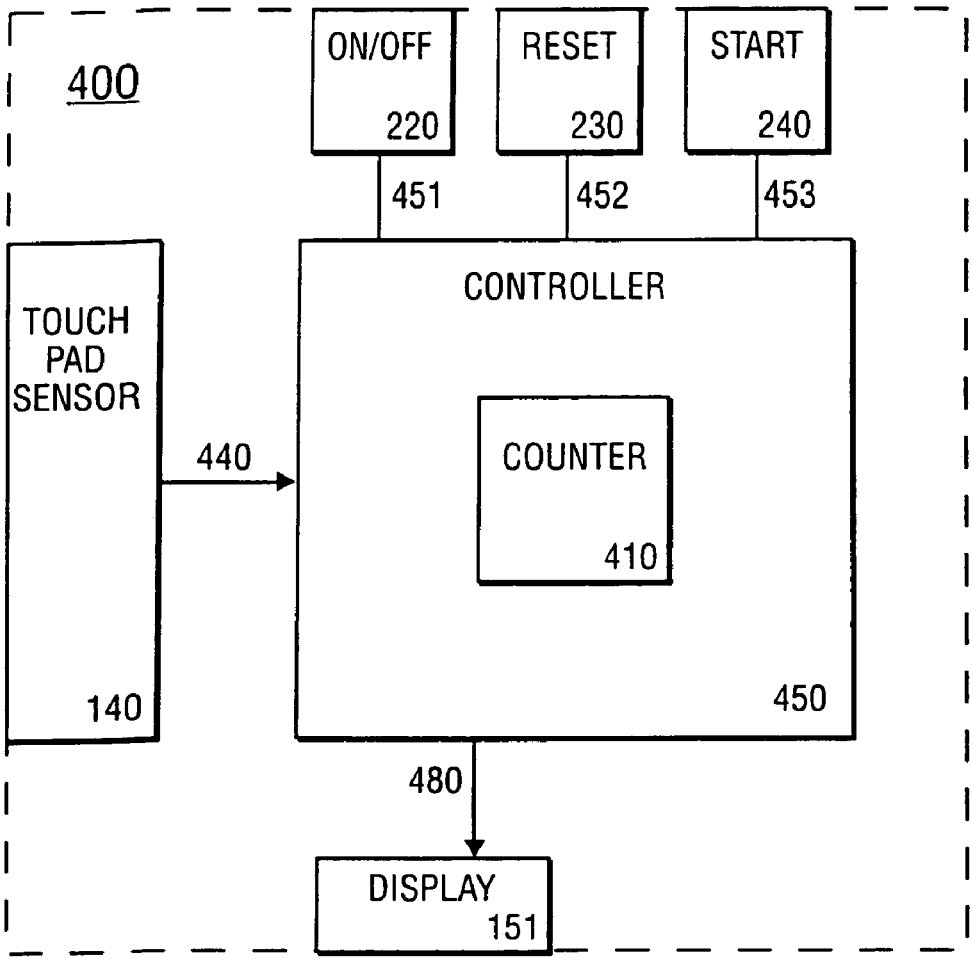
FIG. 4 is one embodiment of the electronic touch controller.

FIG. 4 illustrates one embodiment of the electronic touch controller. Electronic touch controller 400 includes a controller 450, a touch pad sensor 140, an ON/OFF button 220, a RESET button 230, a START button 240, a display 151, and a counter 410.

The touch pad sensor 140 is coupled to the controller 450 through a signal line 440. When touch pad sensor 140 is touched the touch pad sensor 140 sends a signal on the signal line 440 to the controller 450. In one embodiment, the touch pad sensor may be attached to the encasing of the electronic touch controller 450. In another embodiment, the touch pad sensor 140 may be a separate physical unit from the controller 450, and signal line 440 may be a wired or wireless connection. Any portion of the touch pad being touched would activate the signal to the controller. Conventional touch pad sensors are well known to those of ordinary skill in the art.

The ON/OFF button 220 is coupled to the controller 450 through a signal line 451. The ON/OFF 220 button activates and deactivates the controller 450 by sending a signal on the signal line 451 when touched or activated. The RESET button 230 is coupled to the controller 450 through a signal line 452. The RESET button 230 resets the controller 450 to a known initial state and permits the number of "touches allowed" parameter to be entered into the controller 450. The START button 240 is coupled to the controller 450 through a signal line 453. The START button 240 starts the game after the number of "touches allowed" parameter has been entered. The START button 240 permits the electronic touch controller 450 to receive signals from the touch pad sensor 140 on the signal line 440. In one embodiment, the ON/OFF button 220, RESET button 230, and the START button 240 may each be a touch button switch that activates a signal when touched. Such conventional buttons and switches are well known to those of ordinary skill in the art. In another embodiment, the buttons may be signals that are activated by a remote computing device over a wired or wireless network.

The display 151 is coupled to the controller 450 through a signal line 480. The display is an output device for the controller 450. The controller 450 sends data to the display 151. Data may consist of, but is not limited to, the number of "touches allowed" parameter, the current number of touches, the status of the game, the time left in a game, the time that each touch was made, and control signals that may be useful in the playing of the hand-to-hand game including, but not limited to, an ON/OFF signal, a RESET signal, a START signal, etc.

The electronic touch controller 450 of FIG. 4 includes a counter 410. After being activated by the ON/OFF button 220, and after having received the signal from the START button 240, the electronic touch controller 450 receives signals from the touch pad sensor 140, and decrements the number of "touches allowed" parameter with each touch. In another embodiment the counter may be preloaded with a default number of "touches allowed" parameter, and upon receiving a touch signal from the touch pad sensor, the controller 450 decrements the default number of "touches allowed" parameter in the counter. The counter 410 may be, for example, a single chip or circuitry independent from the electronic touch controller 450. In another embodiment, the counter 410 may be implemented using software.

Figure 5:
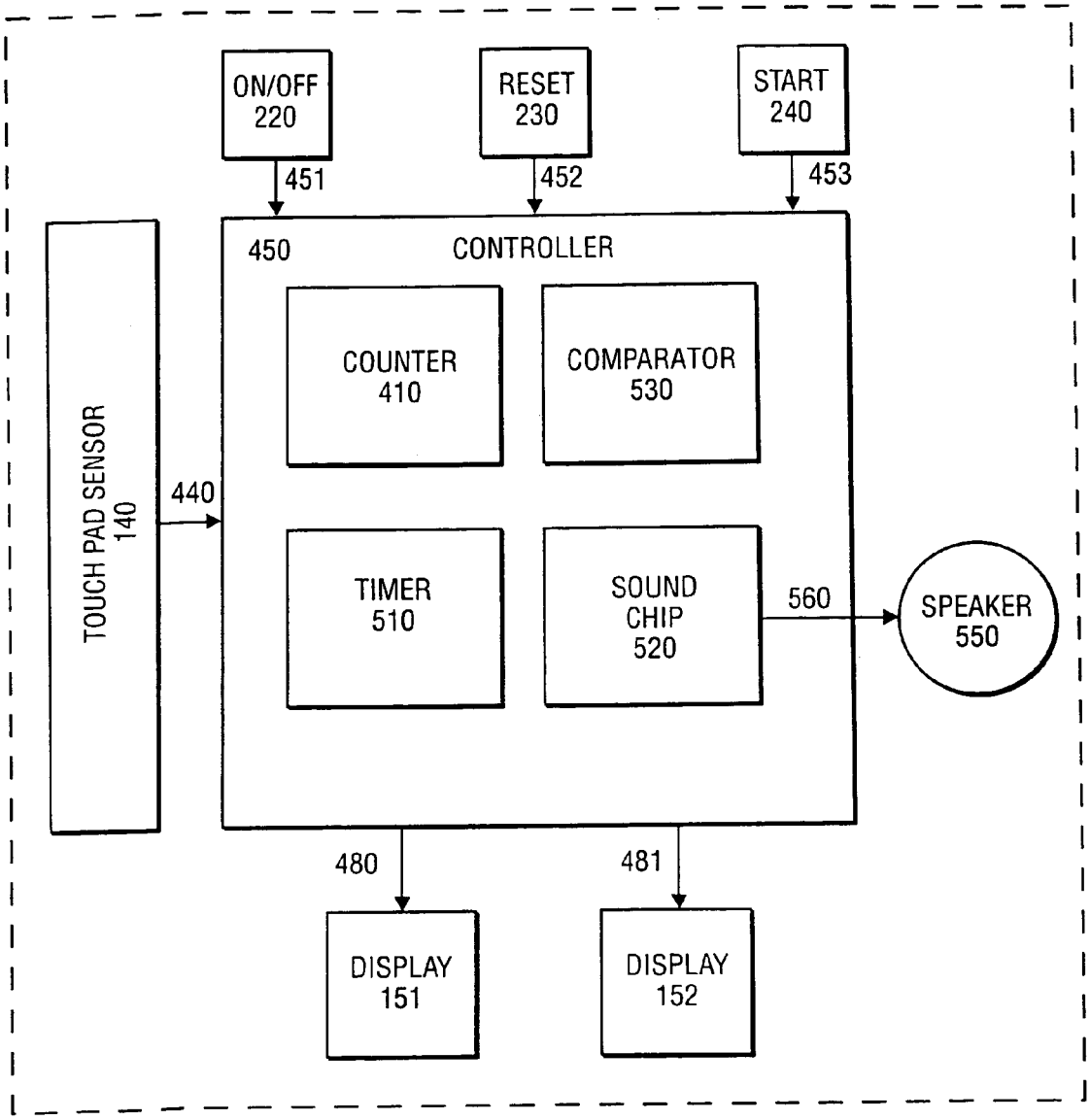
FIG. 5 is another embodiment of the electronic touch controller.

FIG. 5 illustrates another embodiment of the electronic touch controller. In addition to the components described in FIG. 4 of the previous embodiment, the electronic touch controller 500 includes a timer 510, a sound chip 520, a comparator 530, a speaker 550, and a second display 152.

In one embodiment, the controller 450 uses the timer 510 to count up or down. The timer 510 permits time stamping data to be added to each touch signal received by the electronic touch controller 450 from the touch pad sensor 140. In another embodiment, the timer may be used to keep track of the time left in a game. A value may be selected and entered into the timer 510, or the timer 510 may have a preset value.

The controller 450 uses the sound chip 520 to output a signal to the speaker 550. The speaker 550 is coupled to the sound chip 520 through a signal line 560. The speaker is an output device for the controller 450. The controller 450 sends signals to the sound chip 520. The sound chip 520 enables the speaker 550 to play a sound at various points in the game including, but not limited to, when the game starts, when the game ends, and when the controller 450 receives a touch signal from the touch pad sensor 140. The sound played on the speaker 550 may consist of, but is not limited to, an electronic tone, a digital music file, a recorded sound, etc.

The second display 152 is coupled to the controller 450 through a signal line 481. The display is an output device for the controller 450. The controller 450 sends data to the display 152.

The controller 450 of FIG. 5 includes a comparator 530. The controller 450 uses the comparator 530 to make various computations based on data that is receives and stores, which may include, but is not limited to, the "touches allow" parameter, the "actual touches" parameter, time information, etc. In one embodiment, the controller 450 uses the comparator 530 to compare the number of "actual touches" parameter with the number of "touches allowed" parameter that was entered into the controller 450 through the signal line 452 by the RESET button 230. The comparator 530 determines if the number of "actual touches" parameter is equal to the number of "touches allowed" parameter, and if it is, the comparator 530 will output a signal indicating that the game is over to the controller 450. The comparator 530 may be, for example, a single chip or circuitry independent from the counter 410 and the electronic touch controller 450. In another embodiment, the comparator 530 may be implemented using software. In another embodiment, the comparator 530 and counter 410 may be integrated into a single chip or circuitry.

In one embodiment, the components may be individual chips coupled by buses and or signal lines. In another embodiment, the timer 510, sound chip 520, the counter 410 and the comparator 530 (or any combination thereof) may be integrated into a single chip or circuitry. In another embodiment, one or more of these components may be implemented using software.

Figure 6:
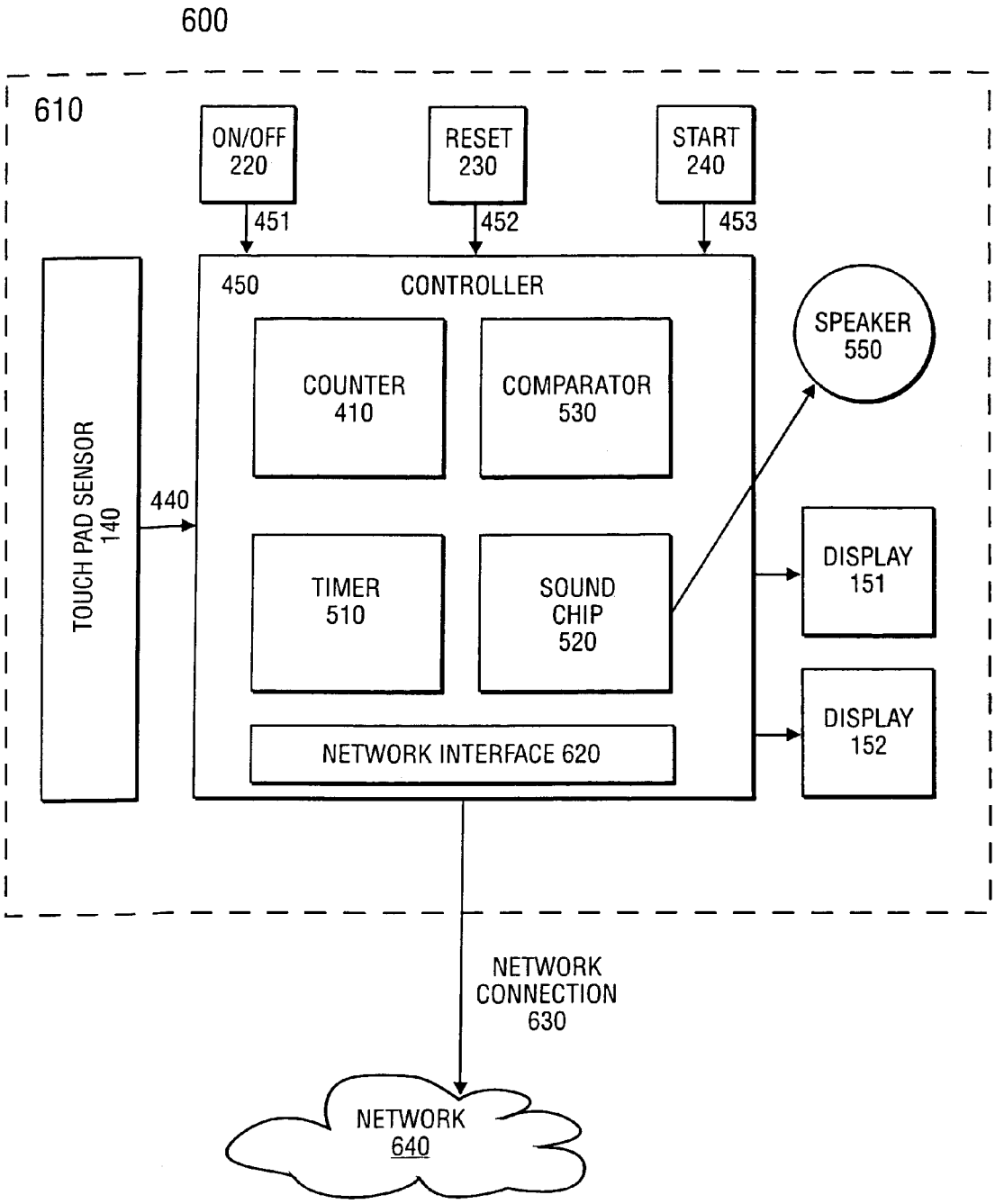
FIG. 6 is one embodiment of the electronic touch system.

FIG. 6 illustrates one embodiment of the electronic touch system. In addition to the components described in FIG. 5 of the previous embodiment, the electronic touch system 600 includes a network interface 620, a network connection 630, and a network 640. The network interface 620 is used to receive and send data between the electronic touch controller 450 and other electronic touch controllers or computing devices on the network 640. The data sent by the electronic touch controller 450 to the network 640 may be utilized in a number of ways including, but not limited to, being transmitted to another computing device, stored at another computing device, displayed on an Internet site, etc. The computing device may be, but is not limited to, a personal desktop computer, a portable computer system, (i.e. a laptop or notebook style computer), a storage device or system, a video game console or system, a hand-held device, email account, or other service or system.

Figure 7:
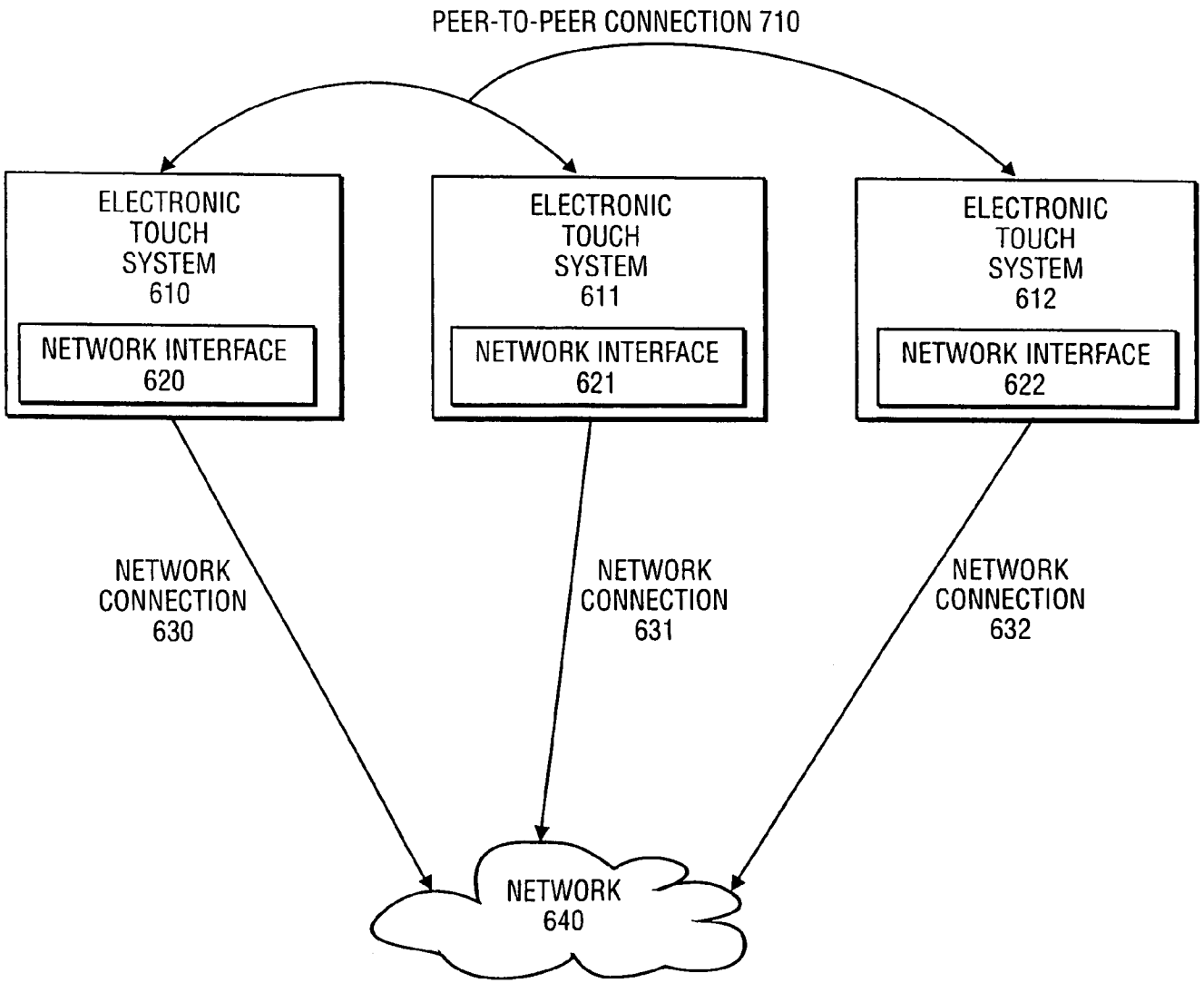
FIG. 7 is another embodiment of the electronic touch system.

FIG. 7 illustrates another embodiment of the electronic touch system. In addition to the components described in FIG. 6 of the previous embodiment, FIG. 7 includes three electronic touch systems 610, 611, and 612, which consist of network interfaces 620, 621 and 622, respectively, and are connected to the network 640 through network connections 630, 631 and 632, respectively. In this embodiment, all of the electronic touch controllers may transmit data to, and receive data from, the other electronic touch controllers in electronic touch system 700, and other computing devices and services on the network 640. In another embodiment, the electronic touch controllers of electronic touch systems 610, 611, and 612 could also send and receive data to and from each other directly via a peer-to-peer network connection 710, which allows the controllers 610, 611 and 612 to communicate with each other without the use of a network 640 and the networks connections 630, 631 and 632.

Figure 8:
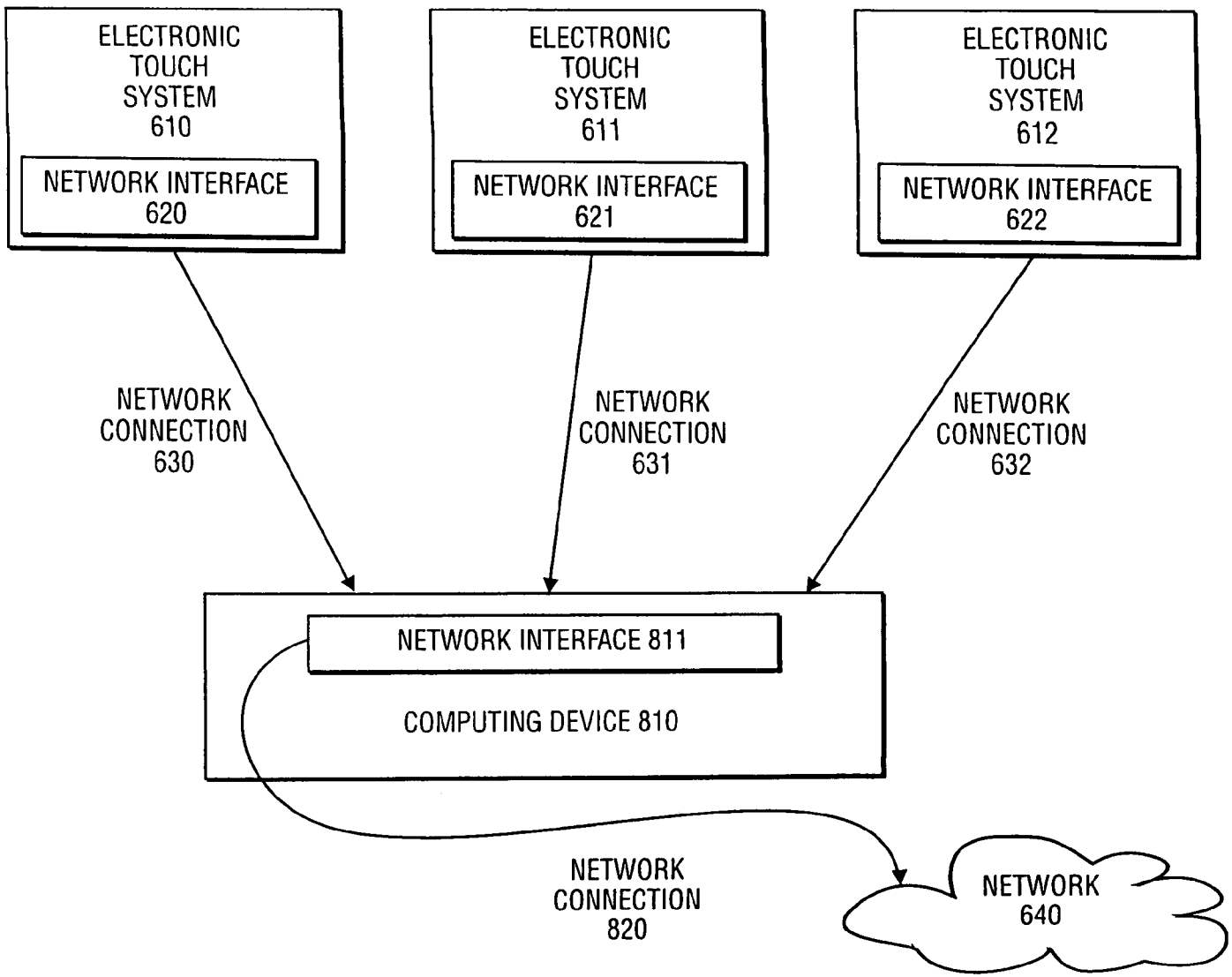
FIG. 8 is another embodiment of the electronic touch system.

FIG. 8 illustrates another embodiment of the electronic touch system. In addition to the components described in FIG. 7 of the previous embodiment, the electronic touch system network 800 includes a computing device 810. The computing device 810 may be, but is not limited to, a personal desktop computer, a portable computer system, (i.e. a laptop or notebook style computer), a storage device or system, a video game console or system, or a hand-held device. The personal computer described above in is a machine-readable medium including any mechanism for storing or transmitting information in a form (e.g., electronic data and signals) readable by a machine (e.g., a computer or other electronic console or device). For example, a machine readable medium may include read only memory (ROM); random access memory (RAM); magnetic disk storage medium; optical storage medium; flash memory devices; electrical, optical, acoustical or other form of propagated signals (e.g., carrier waves, infrared signals, digital signals, etc.); etc.

The electronic touch systems 610, 611 and 612 send and receive data to and from the computing device 810 via network connection 630, 631 and 632. In one embodiment, the computing device consists of a network interface 811 for sending and receiving data to and from the electronic touch systems. The electronic touch systems 700 and 800 described herein may be implemented with three electronic touch controllers, as illustrated by the accompanying figures. It should be noted, however, that the description of the networks using three electronic touch controllers is only for illustrative purposes and is not meant to be limited to three electronic touch controllers. In an alternative embodiment, other numbers of electronic touch controllers may be used. Further, it should also be noted that the game may be played without the use of a network 640 or computing device 810.

In another embodiment, one or more electronic touch systems may be used in a non-competitive application. The electronic touch system may be implemented as a hand/eye coordination learning aid. In another non-competitive embodiment, the electronic touch system may be used to help handicapped individuals or help injured users in rehabilitation.

The network 640 described herein may consist of, but is not limited to, wired networks, wireless networks, or a combination of the two, along with other network technologies. In one embodiment, the network interfaces 620, 621 and 622, the network connections 630, 631 and 632, as well as the network 640 may all be connected via physical wiring (utilizing, but not limited to, technologies such as universal serial bus (USB), serial or parallel cable, Ethernet, telephone lines, etc.) In another embodiment, the network 640 may be a wireless network with a single access point that connects wirelessly to the network interfaces 620, 621 and 622 via wireless network connections 630, 631 and 632 (utilizing, but not limited to, technologies such as Bluetooth or 802.11). The networks may be any type of network including, but not limited to, local area or wide area networks, or public networks (such as the Internet), or a combination of networks. It should be noted, however, that this description of these networks and their connections is only for illustrative purposes and is not meant to be limited to any specific technologies or systems.

Figure 9:
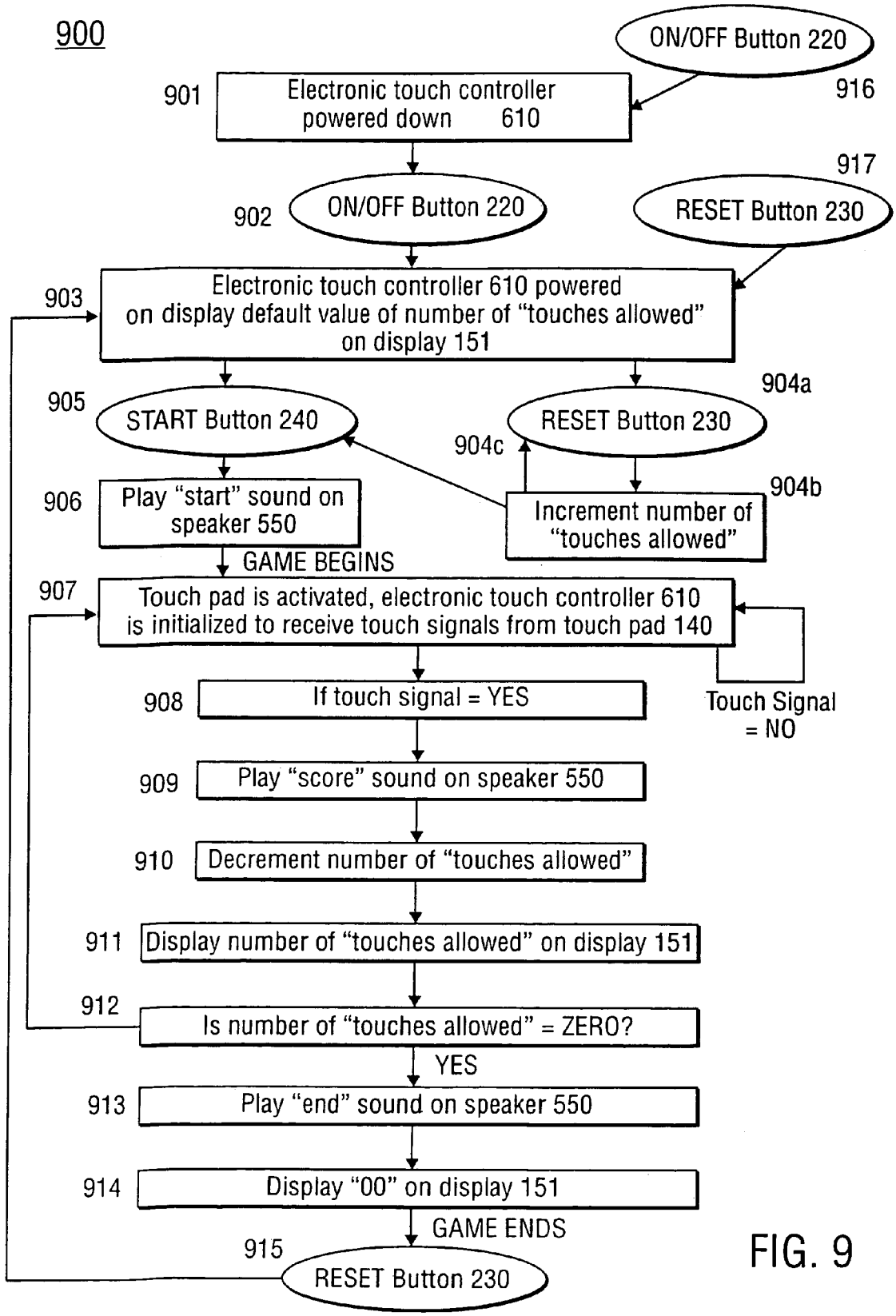
FIG. 9 is a flow chart illustrating one embodiment of a method for playing an improved hand-to-hand game.

FIG. 9 is a flow chart that illustrates one embodiment of a method for playing an improved hand-to-hand game. The method 900 discussed in relation to FIG. 9 is for an implementation of a hand-to-hand game. The game starts with the electronic touch controller 610 powered down, step 901. The player presses the ON/OFF button 220 to power on the electronic touch controller 610, step 902. The electronic touch controller 610 is powered on and sends a signal to the display 151 to display the default value of number of "touches allowed," step 903. In another embodiment, the display may flash the default number on the display. If the default value of number of "touches allowed" is correct, then the player presses the START button 240 on the electronic touch controller 610 to start the game, step 905. If the game requires a different value than the default value of number of "touches allowed," the player presses the RESET button 230, step 904*a*. The reset signal from the RESET button 230 will increment the number of "touches allowed," step 904*b*. In one embodiment, the default value may be ten and increment by a value of ten. It should be noted, however, that the description of the method using a default value of ten and increment value of ten is not meant to be limited to ten. In an alternative embodiment, other numbers may be used to be the default value and the increment value. In step 904*b*, the player may push the RESET button 230 again and increment the number of "touches allowed" by the default value of increments, step 904*c*. When the desired number of "touches allowed" is set, the player presses the START button 240 on the electronic touch controller 610 to start the game, step 905. It should also be noted that if the default value of step 903 is correct, then the player may bypass steps 904*a*, 904*b*, and 904*c* and press the START button 240 on the electronic touch controller 610 to start the game, step 905.

After the START button is pressed, the electronic controller 450 sends a signal to the speaker 550 to play the "start" sound, step 906. The touch pad 140 is activated and the electronic controller 450 is initialized to receive touch signals from the touch pad sensor 140, step 907. It should be noted that, in multi-player embodiments the other players could perform all the steps on their corresponding electronic touch controllers 611 and 612 to start the game, or a computing device may initiate the game for them. It should be noted, however, that the description of these methods for starting a game and setting parameters of a game is only for illustrative purposes and is not meant to be limited to these methods.

After all players have their electronic touch controllers 610–612 at step 907, the game begins. During the game, each player attempts to touch their opponent's touch pad sensors. If the touch pad sensor 140 is touched, a touch signal is sent to the electronic touch controller 450, step 908; the electronic controller sends a signal to the speaker 550 to play the "score" sound, step 909; the number of "touches allowed" parameter is decremented by one, step 910; the electronic touch controller 450 sends a signal to the display 151 to display the decremented number of "touches allowed," step 911. The electronic controller 450 then determines if the number of "touches allowed" is equal to zero, step 912. If the number of "touches allowed" is not equal to zero, then the electronic touch controller 610 goes back to step 907 and is ready to receive another touch signal from the touch pad sensor 140. If the number of "touches allowed" is equal to zero, then the electronic touch controller 450 sends a signal to the speaker 550 to play the "end" sound, step 913. The electronic touch controller 450 also sends a signal to the display 151 to indicate that the number of "touches allowed" left is zero, step 914. It should be noted however, that the description of a single player being touched is only for illustrative purposes and is not meant to be limited to one player. In a multi-player game, the player that is the last person with remaining "touches allowed" wins the game. It should also be noted that the description of these methods for ending a game is only for illustrative purposes and is not meant to be limited to these methods. For example, a game may end when a timer runs out of time, when another player has a set number of "touches allowed" remaining, etc.

The player then presses the RESET button 230 to reset the electronic touch controller 610 to step 903, which displays the default parameter of the number of "touches allowed," step 915. It should also be noted that pressing the ON/OFF button 230 any time during the game turns the electronic touch controller 610 off, step 916, and returns the electronic touch controller to the powered down state of step 901. Also, the RESET button 240 pressed at any time during the game will reset the electronic touch controller 610 to step 903, step 917.

In another embodiment, the game illustrated in FIG. 9 may be altered for the implementation of different rules of the game. For example, in one embodiment of a multi-player game, the goal may be to touch any other player and each touch pad sensor is always active. In another embodiment, as the player receives more touches from other players, the number of "touches allowed" decreases in varying numbers of increments depending on predetermined factors (such as, but not limited to, length of time played, ranking among other players, bonus scoring, etc.).

One embodiment of the game may permit the touch pad sensor to be active for only a portion of the time. Another embodiment may consist of rotating the active touch pad sensors during the game so that different players at different times have active touch pad sensors that can be touched for points. Another embodiment may consist of turning on the electronic touch pad sensors through user intervention, such as a third party non-player.

In another embodiment, a game may use the timer 510 to play in a timed game where the electronic controller 610 counts up (or down) the number of touches and the player with the most (or least) touches during the timed interval wins the game. In another embodiment using the timer 510, the points awarded have greater value in specific time intervals during the game. In another embodiment, the winner may be determined by the highest frequency of touches during the game, such as touches per minute.

Another embodiment of the game may include placing the touch pad sensors to various places of the body. For example, the touch pad sensor may be attached to the back of the leg of each player to be in a difficult to touch position. Another embodiment may also include placing multiple touch pad sensors on different parts of the player's body.

Another embodiment of the game may permit intermissions to allow pausing of the game, maintaining the data in electronic controller 450. The data stored may include, but is not limited to, the number of "touches allowed" parameter, and the time left on the timer. This enables players to continue an unfinished game.

Another embodiment of the game may group players into teams, and the points are accumulated collectively for the team. Another embodiment may be implemented to include an online scenario, with groups of players at different locations, where a touch at one location may be registered at another location, or in combination with touches from another location.

In another embodiment, the electronic touch system 100 may be used concurrently with, or as a component of, another game, either electronic or not. In an electronic scenario for example, a player may follow the rules of touching or defending as dictated by a video game. In a non-electric scenario, the electronic touch pad 100 may also be combined with a board or word game, where the rules of that non-electric game would dictate how, when and whose touch pad you are to touch. Another embodiment may incorporate the electronic touch system into another sport, such as football. Another embodiment may allow for the game to be played concurrently with another sport (for example, boxing while attempting to touch an opponent's target, and the combined score of both sports determine the winner); or sequentially with another sport (for example, in a triathlon-type situation where a series of sports may include a segment where opponents try to touch each others pads, and the combined score of all sports determines the winner.)

Another embodiment of the hand-to-hand game may be played in different physical environments that alter the dynamics of the game, such as using waterproof touch pad sensors for playing underwater games.

In the foregoing specification, the invention has been described with reference to specific exemplary embodiments thereof. It will, however, be evident that various modifications and changes may be made thereto without departing from the broader spirit and scope of the invention as set forth in the following claims. The specification and drawings are, accordingly, to be regarded in an illustrative sense rather than a restrictive sense.

What is claimed is:

1. A method of playing a hand-to-hand game, comprising:

providing a plurality of electronic touch systems to a plurality of players, each electronic touch system comprising:

an attaching device;

a touch pad sensor;

a controller, the controller further including a counter, the controller coupled to the touch pad sensor through a first signal line, the controller coupled to a player using the attaching device;

entering a designated time value into a timer of each of the plurality of electronic touch systems;

commencing the hand-to-hand game by having the plurality of players chase after one another and touch the plurality of touch pad sensors of other players;

decrementing a number of "touches allowed" by a default decrement value for each touch received from another player;

terminating play once there is no time left on the timer, declaring as a winner the player with the most number of "touches allowed".

2. The method of playing a hand-to-hand game of claim 1, further comprising:

calculating a frequency of touches for each player for a time period;

declaring as a winner the player who obtains the highest frequency of touches for the time period.

* * * * *